United States Patent [19]

Rienzo

[11] Patent Number: 4,765,622

[45] Date of Patent: Aug. 23, 1988

[54] HOCKEY GAME

[76] Inventor: Donald D. Rienzo, 511 Wolf Hill Rd., Dix Hills, N.Y. 11746

[21] Appl. No.: 673,663

[22] Filed: Nov. 21, 1984

Related U.S. Application Data

[63] Continuation of Ser. No. 464,345, Feb. 7, 1983, abandoned.

[51] Int. Cl.[4] ..... A63F 7/06

[52] U.S. Cl. ..... 273/85 R

[58] Field of Search ..... 273/85 R, 85 A, 85 B, 273/85 C, 85 D, 126 R, 126 A, 118–120, 122–123, 125, 127 B

[56] References Cited

U.S. PATENT DOCUMENTS

| | | | |
|---|---|---|---|
| 829,947 | 9/1906 | Carter | 273/85 R |
| 1,144,112 | 6/1915 | Denny | 273/85 R |
| 1,615,491 | 1/1927 | Thornton | 273/85 D X |
| 1,819,932 | 8/1931 | Walden | 273/85 |
| 2,282,846 | 5/1942 | Barbot et al. | 273/85 D |
| 2,769,638 | 11/1956 | Knapp | 273/85 D |
| 2,824,739 | 2/1958 | Frank | 273/85 R X |
| 3,120,391 | 2/1964 | Fletcher | 273/85 R X |
| 3,202,427 | 8/1965 | Patent | 273/85 R X |
| 3,228,688 | 1/1966 | Dennison | 273/85 R |
| 3,574,350 | 4/1971 | May | 273/85 D |
| 4,032,150 | 6/1977 | Wilson | 273/126 R |
| 4,166,620 | 9/1979 | Sheppard | 273/85 R X |
| 4,173,338 | 11/1979 | Barnett | 273/85 R X |
| 4,274,635 | 6/1981 | Pakogian | 273/85 R |

FOREIGN PATENT DOCUMENTS

| | | | |
|---|---|---|---|
| 628764 | 9/1949 | United Kingdom | 273/85 R |

OTHER PUBLICATIONS

Hockey Game of Fun, M. G. L. Co., AO in N.Y. Times, 12/11/66, p. S 25.

Reader's Digest Book of 1000 Family Games, © 1979, pp. 228, 229, Box Hockey.

*Primary Examiner*—Paul E. Shapiro

*Attorney, Agent, or Firm*—Roberts, Spiecens & Cohen

[57] ABSTRACT

A hockey game comprising a board having a playing surface and longitudinal and transverse boundary side walls. Each of the transverse side walls has a pair of spaced slots through which an object such as a puck or ball can pass to score a goal. A playing stick is provided for each player for striking the object to propel the object on the playing surface, the playing stick being dimensioned to permit the player to stand adjacent the board and swing the stick from above the playing surface to strike the object. A barrier is removably insertable in the longitudinal side walls for extending transversely across the board midway of the length of the board, the barrier being provided with an aperture for allowing passage of the object therethrough.

10 Claims, 2 Drawing Sheets

HOCKEY GAME

This is a continuation of application Ser. No. 464,345, filed 2/7/83, now abandoned.

FIELD OF THE INVENTION

The invention relates to a game, more particularly, a hockey game adapted for being played by two or more persons each utilizing a playing stick which is dimensioned to permit the user to stand adjacent a board and swing the stick from above the board to strike an object such as a puck.

PRIOR ART

There are numerous hockey games which are known involving the use of various means to strike a puck-like object and effect a score by driving the puck through an opening.

A typical known game involves the use of hand held strikers in which the striking motion to propel the object is mainly obtained by a wrist action or by bending the elbow. The participants either sit or stand with the board placed on a table in front of them.

Also known are games in which simulated players are moved on a board by manipulating levers and handles to approximate play in a hockey game. This involves small motor skills with hand and wrist action.

Games are also known in which a playing court is erected and the players use full scale hockey sticks. An example of such a game is found in U.S. Pat. No. 3,709,489 (Holleran et al). In such a game, a large size playing field is required.

Another game is shown in U.S. Pat. No. 3,794,318 (Holmes) in which pucks are successively fed and the player attempts to put the pucks through an exposed hole in a target. Although this apparatus also requires a large amount of space, it also lacks the aspect of competitive action between two or more players.

SUMMARY OF THE INVENTION

An object of the invention is to provide a hockey game of relatively small size which simulates the action of stick handling and puck shooting in the conventional game.

A further object of the invention is to provide a hockey game which is portable and is easily set up.

A further object of the invention is to provide a hockey game in which the players utilize playing sticks which are dimensioned to permit the players to stand adjacent a game board and swing the stick from above the playing surface of the board to strike the puck to propel the same.

Another object of the invention is to provide a game in which two or more players can compete with one another, exercising both defensive and offensive skills.

Still another object of the invention is to provide a hockey game in which means can be provided to make the game more or less demanding depending upon the skill of the players.

Still another object of the invention is to provide a hockey game in which the playing surface is set up on the floor and the players stand along side the playing surface while playing the game.

In accordance with the above and further objects of the invention, there is provided a game which comprises means defining a board having a playing surface including longitudinal and transverse bounding side walls. The transverse side walls each has a pair of spaced slots constituting goals. An object such as a puck is adapted for travel on the playing surface and is shaped and dimensioned to pass through the slots. A playing stick is provided for each player for striking the object to propel the object on the surface. The playing stick is dimensioned to permit the player to stand adjacent the board and swing the stick from above the playing surface to strike the object.

The board includes means adapted for resting the board on a floor.

In further accordance with the invention a barrier means is removably inserted in the longitudinal side walls for extending transversely across the board midway of the length of the board. The barrier means is provided with aperture means for allowing the passage of said object therethrough. The presence of the barrier means greatly increases the degree of skill necessary to propel the object from one side of the barrier means through the aperture means therein and through one of the pair of spaced slots on the opposite side to score a goal.

In order to make the game portable, the board is provided with a hinge which allows the board to be folded at the center thereof.

In order to keep track of elapsed time and of the score, an electrical means is provided for sensing passage of the object through said slots for signaling such passage and for signaling passage of predetermined time intervals.

The invention will be described in greater hereafter with reference to a specific embodiment which is illustrated in the attached drawing.

BRIEF DESCRIPTION OF THE SEVERAL FIGURES OF THE DRAWING

DETAILED DESCRIPTION

Figure 1:
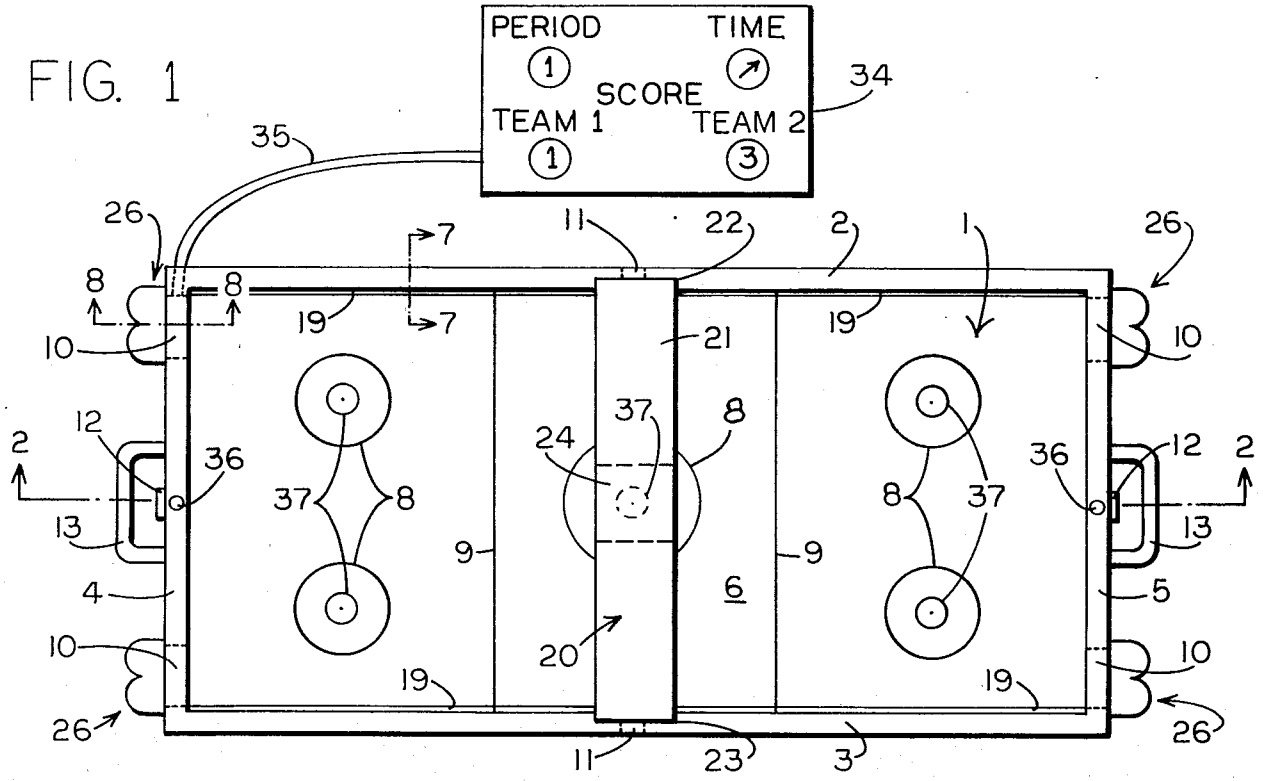
FIG. 1 is a top plan view diagrammatically illustrating a board of a game according to the invention.
Figure 2:
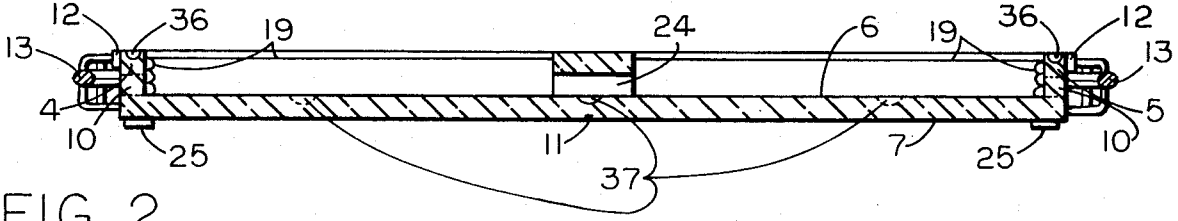
FIG. 2 is a longitudinal cross-section taken through the board in FIG. 1 along line 2—2.

Referring to FIGS. 1 and 2 therein is seen a game board 1 which is formed with longitudinal bounding side walls 2 and 3 and transverse end walls 4 and 5. Within the outline of the longitudinal and transverse walls there is formed a playing surface 6 on the upper surface of a base panel 7.

The playing surface 6 is provided with suitable markings representative of the game of ice hockey inclusive of face-off circles 8 and blue lines 9.

A pair of slots 10 are formed in the respective transverse end walls 4 and 5 and are adapted to serve as goals whereby a score is made by driving an object through one of the slots. As seen in FIG. 1, the slots are located at the ends of the respective transverse wall where said wall is joined to the longitudinal walls 2 and 3.

The walls and bottom of the game are made of a rugged material such as wood or a suitable plastic material, as for example, rigid polypropylene.

Figure 3:
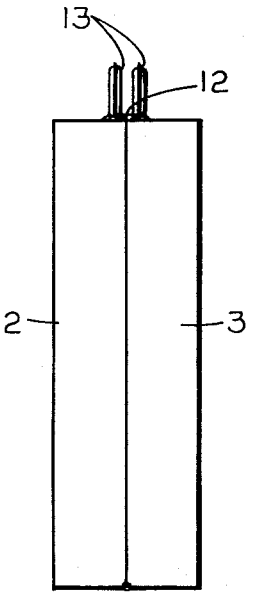
FIG. 3 shows the board of FIG. 1 in a folded position adapted for transport.

The bottom panel 7 is provided with a hinge means 11 which permits the game to be folded from its flat configuration as shown in FIGS. 1 and 2 to a folded configuration as shown in FIG. 3. A suitable latch mechanism 12 and handles 13 can be provided on the end walls 4 and 5 to lock the board in its folded position as shown in FIG. 3 and permit the same to be easily transported.

Figure 4:
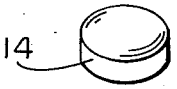
FIG. 4 is a perspective view showing a cylindrical puck for use with the board of FIGS. 1–3.
Figure 5:
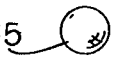
FIG. 5 is a perspective view showing a spherical ball which can be utilized with the board of FIGS. 1–3.

The game can be played with a cylindrical disc-like puck 14 as shown in FIG. 4 in which case the game will simulate ice hockey or it can be played with a spherical ball 15 as shown in FIG. 5 in which case the game will simulate a game known as Bandy. Bandy is similar to ice hockey and is played with a ball rather than a puck.

Figure 6:
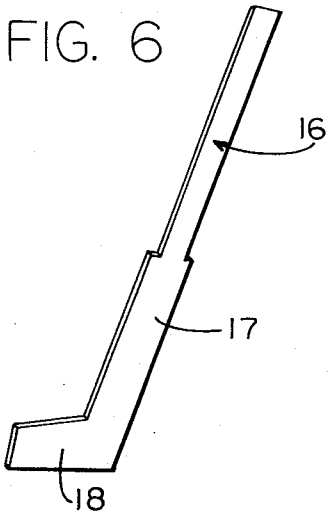
FIG. 6 shows a stick which is usable with either of the articles in FIGS. 4 and 5 on the board shown on FIGS. 1 and 2.

In order to propel the playing object i.e. the puck or ball, each player utilizes a stick 16 as shown in FIG. 6 which is a small scale version of a hockey stick (also used for Bandy). In actuality, the hockey stick 16 simulates a stick used by the goalie in that it employs a widened region 17 which extends into the blade 18.

The game may be played with one player on each side or with two players on each side and goals are scored by passage of the object through any of the slots 10. Each player stands adjacent the board and swings the stick from above the playing surface to strike the object to propel the object along the playing surface. The object can travel directly from the player's stick into the slot 10 or it can rebound from one of the longitudinal or transverse walls into the slot. Defensive play is achieved by attempting to halt the passage of the object to the defender's slots. The playing stick is dimensioned so that the player will use wrist, elbow and shoulder action in propelling the object in much the same manner as in the corresponding full scale game of ice hockey or Bandy.

The face-off circles 8 are utilized to achieve face-off when the object is driven from the face of the board in much the same manner as in the regular game of ice hockey or Bandy.

In order to provide a simulation of propelling the object with the stick as in the full scale game while also offering a degree of difficulty in scoring, it is essential that the stick, puck or ball and slots be suitably dimensioned. In this regard, the puck has a diameter of 2 inches and a thickness of $\frac{3}{8}$ inch, the slots 10 have a height of one inch and a width of $2\frac{3}{4}$ inches and the stick has a length of 28 inches while its blade has a length of 3 inches. When the game of Bandy is played, a ball of 15/16 inch diameter is utilized.

With the above dimensions there is a relatively high degree of difficulty in scoring which keeps the score of a game played in a given time period of, for example, three periods of five minutes each similar to that in regular ice hockey or Bandy. The length of the game board is about 5 feet and the width about 3 feet.

In order to provide variation in the play of the game, the composition of the ball and the puck can be changed. Thus, in one embodiment, the ball and puck are made of wood which tends to make the game slower in operation whereas for faster play, the ball and puck are made of a plastic material, such as PVC.

Figure 7:
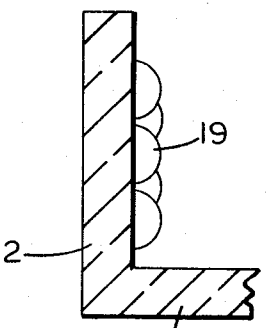
FIG. 7 is a sectional view taken on line 7—7 in FIG. 1.

In order to provide "live" rebound of the object from the longitudinal side walls 2 and 3, a resilient bumper in the form of a covering 19 is provided on the inside surface of the walls 2 and 3 as shown in FIG. 7. The coating 19 may be a resilient material which may, for example, be provided with convex protrusions over the extent of its surface in order to provide unexpected rebound angles of the object.

When the players have developed increasing skill with the game, an object of the invention is to provide for a greater degree of difficulty by providing a barrier means 20 which extends transversely across the game midway of the length of the longitudinal side walls 2 and 3. The barrier means 20 is in the form of a transverse wall 21 which is removably insertable into grooves 22 and 23 respectively formed in side walls 2 and 3. The wall 21 is provided with a slot 24 which is centrally located at the bottom of the wall so as to be open at the surface 6 of the board as shown in FIG. 2. In this way, the object must pass through the slot 24 in going from one side of the board to the other. This requires a substantially increased degree of skill for the player to drive the object through the slot 24 and then into the slot 10 either directly or on a rebound from a side wall. The slot 24 is dimensioned in relation to the object namely, to the puck 14 or the ball 15 to form a limited filed for passage of the object from one side to the other by which a goal can be scored by passage through a slot 10. In particular, the slot 24 has a width of 4 inches and a height of one inch. Thus, the slot 24 has a width which is equal to two times the diameter of the puck 14 and is between 4 and 5 times the diameter of the Bandy ball 15. The height of slot 24 is between two and two and one half times the thickness of the puck and is only slightly greater than the diameter of the Bandy ball. Thus, the ball has to be virtually flush with the surface 6 in order to pass through the slot 24.

In further accordance with the invention, different slot sizes for slot 24 can be provided in different barrier walls 21 in order to vary the degree of skill necessary for the players. As a further option, a barrier wall 21 can be provided with a semi-circular aperture for particular use with Bandy ball 15. In such case, the slot 24 would then have a diameter, at least, 50% greater than the diameter of the Bandy ball 15.

As has been previously indicated, the board is intended for resting on the floor with the players standing adjacent the board for swinging the stick 16 from above the playing surface 6 to strike the object and propel the same. In order to rest the board on the floor, feet 25 can be provided at the four corners of the bottom panel 7.

A goal 26 is detachably fastened to each of the transverse end walls 4 and 5 in back of each slot 10. The goal 26 includes a rigid wire frame 27 to which is secured a netting 28 made of any open weave material in substantially the same manner as a conventional ice hockey goal. After the object has passed through a slot 10 it strikes the netting 26 as in the actual games.

An electrical system is provided for keeping score and for keeping time of the game.

Figure 8:
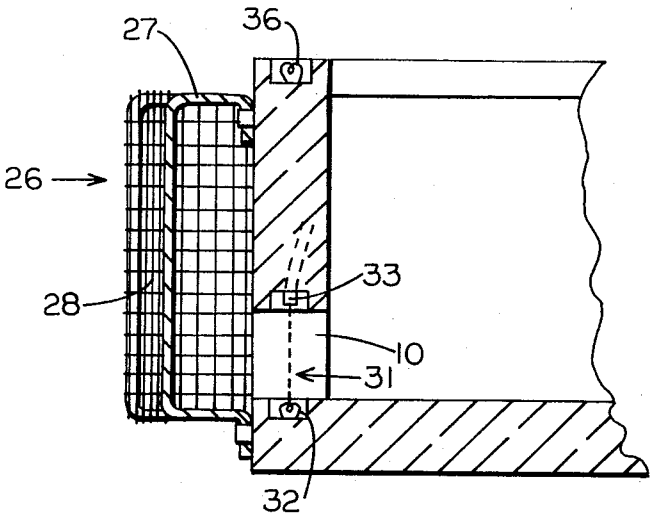
FIG. 8 is a sectional view on enlarged scale of a portion of the game in FIGS. 1 and 2 taken along line 8—8 in FIG. 1.

For this purpose there is provided at each slot 10 a means for sensing passage of an object. through the slot such as a photoelectric sensor means 31. As seen in FIG. 8, the photoelectric sensor means 31 comprises a photoelectric cell 32 aligned with a detector 33 to set up a light path which is broken when an object passes between them. The detector 33 is connected to a scoreboard 34 by wires 35 schematically illustrated in FIGS. 1 and 8 which keeps track of the score for each side. The cell 32 and detector 33 can be covered with a transparent cover to protect them without interfering with the light path.

In order to stimulate the indication of a goal, as in regular ice hockey, red light bulbs 36 are recessed in corresponding openings in the end walls 4 and 5 and are connected in circuit with the detectors 33 and the scoreboard 34 in order to be illuminated when a goal is scored i.e. when an object passes through a slot 10. The recesses for bulbs 36 can be provided with removable transparent covers to protect the bulbs while permitting their replacement. Power for the bulbs 36 and for the scoreboard and sensor means 31 can be achieved with batteries or with a conventional AC power source. In addition to the score, the scoreboard 34 can contain an alarm means connected in circuit with the sensor means 31 and the bulbs 36 to provide an audible signal when a goal is scored. Additionally, the scoreboard can contain a timer to establish the time of periods and to indicate audibly and/or visually, the end of periods. The circuit can be suitably constructed to preclude the scoring of goals after the completion of a period.

In order to hold the ball 15 in place in the game of Bandy during face-offs, the center face-off circle 8 and the other face-offs circles 8 in the player's zones are provided with recesses 37. The recesses 37 will not interfere with the travel of the puck 14 on the playing surface 6.

Although the invention has been described in relation to a specific preferred embodiment thereof, it will become apparent to those skilled in the art that numerous modifications and variations can be made within the scope and spirit of the invention as defined in the attached claims.

What is claimed is:

1. A game comprising means defining a board having a playing surface and including longitudinal and transverse boundary side walls, said transverse side walls each having a pair of spaced slots, an object adapted for travel on said playing surface and shaped and dimensioned to pass through said slots, a playing stick for striking said object to propel the object on said surface, said playing stick being dimensioned to permit the user to stand adjacent to the board and swing the stick from above the playing surface to strike the object, barrier means removably insertable in said longitudinal side walls for extending transversely across said board midway of the length of the board, said barrier means being solid and provided with aperture means for allowing passage of said object therethrough and hinge means for folding the board at the center thereof with the barrier means removed, each transverse side wall having opposite ends whereat the transverse side wall is joined to said longitudinal side walls and except for said slots the remainder of each transverse wall is solid, said slots of each pair in each transverse side wall being located at the respective ends of the associated transverse side wall where the side wall is joined to the longitudinal side walls, said aperture means extending in said barrier means to form a single central opening therein which extends upwardly from the playing surface of the board, said slots having a substantially smaller width than said opening.

2. A game as claimed in claim 1 wherein said board further includes means adapted for resting the board on a floor.

3. A game as claimed in claim 1 wherein said opening is dimensioned in relation to said object to permit the object to pass therethrough without obstruction from a limited field of said playing surface.

4. A game as claimed in claim 3 wherein said opening has a width of about two times the maximum extent of said object, said slots having a substantially smaller width than said opening.

5. A game as claimed in claim 1 comprising bumper means on said longitudinal walls of said board.

6. A game as claimed in claim 1 comprising a netting material on said transverse walls adjacent said slots.

7. A game as claimed in claim 1 comprising electrical means (1) for sensing passage of said object through said slots, (2) for signaling such passage, and (3) for signaling passage of predetermined time intervals.

8. A game as claimed in claim 1 further comprising recess means on said board beneath said barrier means normally inoperative in the game when the barrier means is in place and operative in the game when the barrier means is removed.

9. A game as claimed in claim 8 wherein said object comprises a puck of disc shape and a ball selectively usable for playing different games on said board.

10. A game as claimed in claim 8 further comprising further recess means in said playing surface for cooperating with said object in playing the game.

* * * * *